US005770340A

United States Patent [19]

Nakayama et al.

[11] Patent Number: 5,770,340

[45] Date of Patent: Jun. 23, 1998

[54] IMAGE FORMATION METHOD USING SCANNING EXPOSURE

[75] Inventors: Takao Nakayama; Eiichi Kato; Kazuo Ishii, all of Kanagawa, Japan

[73] Assignee: Fuji Photo Film Co., Ltd., Kanagawa, Japan

[21] Appl. No.: 578,952

[22] Filed: Dec. 27, 1995

[30] Foreign Application Priority Data

Dec. 27, 1994 [JP] Japan ..... 6-325900
Apr. 3, 1995 [JP] Japan ..... 7-077797

[51] Int. Cl.[6] ..... G06C 13/04

[52] U.S. Cl. ..... 430/95; 430/945

[58] Field of Search ..... 430/84, 95, 49, 430/945

[56] References Cited

U.S. PATENT DOCUMENTS 4,168,165 9/1979 Kato et al. ..... 430/63
4,929,527 5/1990 Kato et al. ..... 430/92
5,089,367 2/1992 Murasawa et al. ..... 430/84

*Primary Examiner*—John Goodrow
*Attorney, Agent, or Firm*—Sughrue,Mion,Zinn,Macpeak & Seas, PLLC

[57] ABSTRACT

A method for forming an image using scanning exposure of an electrophotographic lithographic printing plate comprising an electrically conductive support having thereon a photoconductive layer containing an inorganic photoconductor, a chemical sensitizer, a sensitizing dye and a binder resin, and a back layer on the opposite side of the photoconductive layer, wherein the back layer has a surface resistivity of $1\times10^{10}$ Ω or less and the sensitizing dye in the photoconductive layer is at least one selected from the compounds represented by formulae (I) and (II) defined in the disclosure.

2 Claims, 1 Drawing Sheet

IMAGE FORMATION METHOD USING SCANNING EXPOSURE

FIELD OF THE INVENTION

The present invention relates to an image formation method using scanning exposure, more specifically, it relates to an image formation method using scanning exposure which ensures stable and excellent electrophotographic properties free from dependency upon the environment, gives an image excellent in the uniformity and is suitable for development in a direct feeding system.

BACKGROUND OF THE INVENTION

According to a conventional method for producing a lithographic printing plate in electrophotography, a photoconduct layer of an electrophotographic lithographic printing plate is uniformly charged and imagewise exposed, the exposed plate is subjected to wet development with a liquid toner to obtain a toner image which is then fixed, and thereafter the plate is processed with a desensitizing solution (etching solution) to hydrophilize the non-image area free of the toner image is commonly used.

As a support for the above-described lithographic printing plate, a paper imparted with an electric conductivity has hitherto been used but the printing durability or photographic properties are affected by the penetration of water into the support. More specifically, the above-described etching solution or fountain solution at the printing penetrates into the support thereby expanding the support, which sometimes causes separation between the support and the photoconductive layer thereby reducing the printing durability. Also, the water content of the support varies depending upon the temperature and humidity conditions in an atmosphere during the above-described electrostatic charging or exposure and whereby the electric conductivity of the support is changed to impair the photographic properties. Further, lack of water resistance causes wrinkles during printing.

In order to overcome these problems, it has been proposed to coat one or both sides of the support with a water-resistant material, for example, an epoxy resin or an ethylene and acrylic acid copolymer (see, JP-A-50-138904 (the term "JP-A" as used herein means an "unexamined published Japanese patent application"), JP-A-55-105580 and JP-A-59-68753) or to provide a laminate layer such as polyethylene (see, JP-A-58-57994).

A layer coated as a back coating layer on the surface opposite to the surface having a photoconductive layer (printing surface, top) of the support is called a back layer and various improvements have been made to compositions for the back layer so as not only to impart the above-described water resistance but also to retain various functions described below.

As a developing method for an electrophotographical plate-making type printing plate in place of the conventional method wherein a master is passed through a developer flowing between electrodes, the present inventors had achieved a wet developing method in a so-called direct feeding system wherein a conductor is used instead of the electrode on the side opposite to the printing surface and the development is conducted while feeding charge from this conductor directly to the back surface side of the support, as disclosed in JP-A-1-26043. According to this developing method, the development speed can be hastened, the solid image can be formed uniformly and the adhesion of toner to the back electrode of a developing machine can be prevented.

To suit with this direct feeding system, the present inventors have proposed a plate comprising a support having on both sides thereof a polyolefin laminate layer and, as a back layer of the support, a layer having a surface electric resistance of $1\times10^{10}$ Ω or less and a friction resistance larger then that of the polyolefin laminate layer, whereby the plate can be accurately taken up around and fixed to a drum of a printing machine to prevent dislocation of printing, thereby enabling to carry out good electrophotographic plate-making and development in a direct feeding system. (see, JP-A-2-84665). Further, they have proposed a plate comprising a support having on the front surface thereof an under layer and a photoconductive layer and on the back surface thereof a back layer, in which the under layer and the back layer are controlled to have a surface resistivity of from $1\times10^{8}$ to $1\times10^{14}$ and of $1\times10^{10}$ or less, respectively, whereby an image can be formed correctly, satisfactory and swiftly and in case of a solid image plane, a uniform image can be formed without generating pinholes in either wet development of conventional system or the direct feeding system; and a developing method thereof (see, JP-A-2-132464).

On the other hand, the image exposure method includes a scanning image exposure method using laser beams. Particularly in recent years, as a low output semiconductor laser is developed, a photosensitive material sensitive to the wavelength region of 700 nm or more is being demanded. Such a photosensitive material uses various sensitizing dyes and is required to show satisfactory sensitivity to near infrared light or infrared light and also to have good dark-charge receptive properties.

A photosensitive material comprising the foregoing support suitable for the direct feeding system and having provided thereon a low resistance back layer is improved in the stability of the electrophotographic properties (in particular, sensitivity) against change in the environment in comparison with conventional photosensitive materials for indirect feeding, as described in JP-A-1-26043. However, when scanning exposure using the above-described laser beam is conducted on the photosensitive material comprising a support having provided thereon a low resistance back layer for the direct feeding system, the electrophotographic properties (in particular, dark-charge receptivity, sensitivity) are deteriorated remarkably due to changes of the environment depending upon the kind of the sensitizing dye, thereby causing problems with respect to uniformity and storage stability of the image.

SUMMARY OF THE INVENTION

In order to overcome the above-described problems, the present inventors have made intensive investigations and as a result, they have found that the foregoing problems can be successfully solved by using a specific sensitizing dye in an electrophotographic lithographic printing plate having a low resistance back layer for use in a direct feeding system. More specifically, the problems can be solved by the present invention of the following constructions.

Namely, the present invention provides (1) a method for forming an image using scanning exposure of an electrophotographic printing plate comprising an electrically conductive support having thereon a photoconductive layer containing an inorganic photoconductor, a chemical sensitizer, a sensitizing dye and a binder resin, and a back layer on the opposite side of the photoconductive layer, wherein the back layer has a surface resistivity of $1\times10^{10}$ Ω or less and the sensitizing dye in the photoconductive layer is at least one dye selected from the compounds represented by the following formulae (I) and (II):

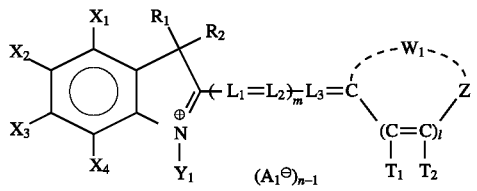

(I)

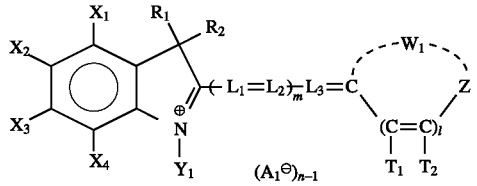

(II)

wherein $R_1$ and $R_2$, which may be the same or different, each represents an alkyl group, an alkenyl group or an aralkyl group or $R_1$ and $R_2$ may be a hydrocarbon group for forming an alicyclic ring together;

$X_1$, $X_2$, $X_3$ and $X_4$, which may be the same or different, each represents a hydrogen atom or a group selected from respective substituent groups defined by the Hammett's substituent constant, or $X_1$ and $X_2$ or $X_3$ and $X_4$ may be a hydrocarbon group for forming a benzene ring together;

$Y_1$ represents an alkyl, alkenyl or aralkyl group which may be substituted;

Z represents an oxygen atom, a sulfur atom, a selenium atom, a tellurium atom or a nitrogen atom substituted by a substituent $Y_2$ (wherein $Y_2$ has the same meaning as $Y_1$ above and $Y_1$ and $Y_2$ in each formula may be the same or different);

$W_1$, represents an atomic group necessary for forming an indolenine, naphthoindolenine, pyran, benzopyran, naphthopyran, thiopyran, benzothiopyran, naphthothiopyran, selenapyran, benzoselenapyran, naphthoselenapyran, tellurapyran, benzotellurapyran, naphthotellurapyran, benzothiazole or naphthothiazole ring which may be substituted or an atomic group necessary for forming a nitrogen-containing heterocyclic ring which may be substituted;

$W_2$ represents an onium salt of a heterocyclic group as formed in the manner defined for $W_1$;

$T_1$, and $T_2$, which may be the same or different, each represents a hydrogen atom, an aliphatic group or an aromatic group;

$L_1$, $L_2$, $L_3$, $L_4$, $L_5$ and $L_6$, which may be the same or different, each represents a methine group which may be substituted;

represents 0 or 1;

m represents 2 or 3;

$A_1^-$ represents an anion; and n represents 1 or 2, provided that when the dye molecule contains a sulfo group or a phospho group, an inner salt is formed and n is 1.

The present invention also provides (2) an image formation method using scanning exposure as described above as (1), wherein the electrophotographic lithographic printing plate is subjected to wet development by disposing an electrode to face the photoconductive layer, supplying a developer between the electrode and the photoconductive layer and bringing a conductor into contact with the surface of the back layer.

DETAILED DESCRIPTION OF THE INVENTION

Figure 1:
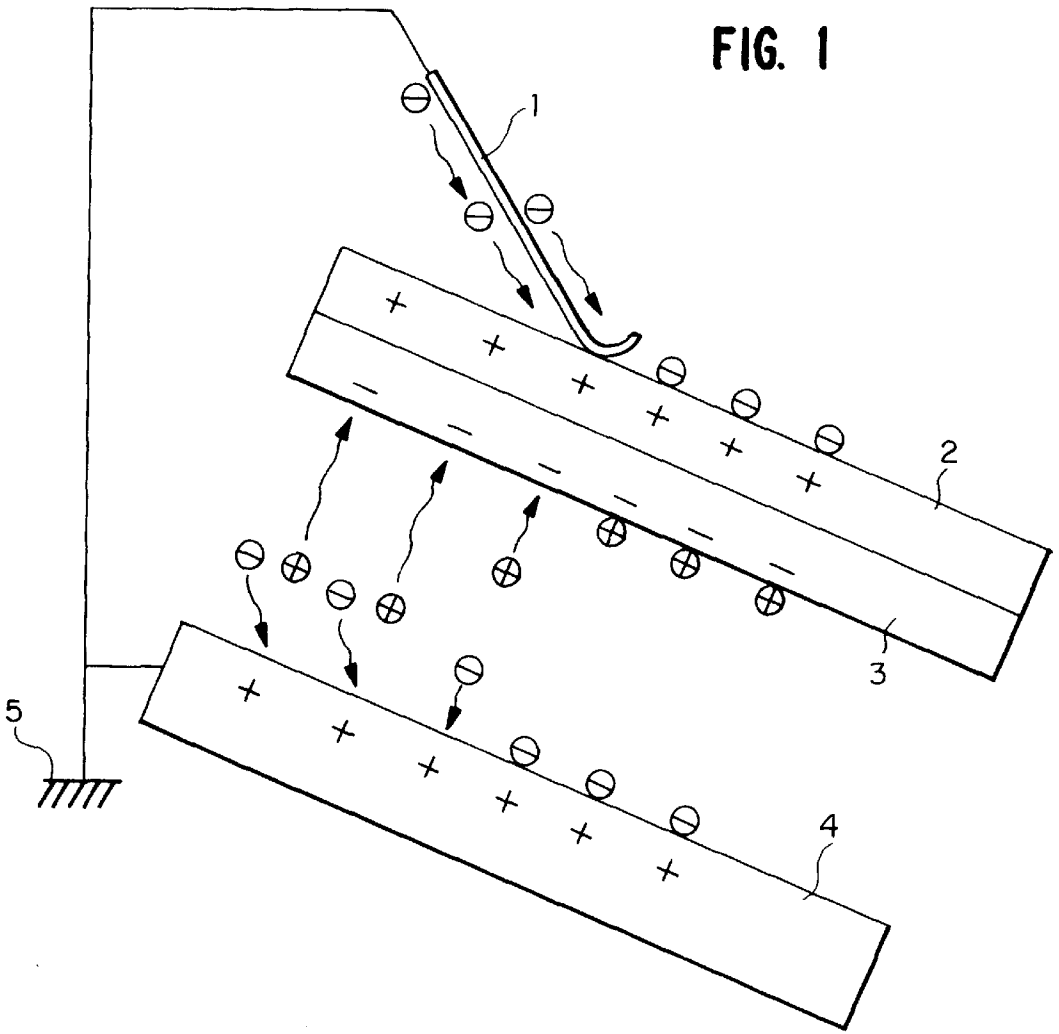
FIG. 1 is a principle view of a development method in a direct feeding system which is suitably used in the present invention.

The method of the present invention is described below in detail.

In the present invention, the back layer provided on the electrically conductive support has a surface resistivity of preferably $1\times10^{10}$ Ω or less, more preferably $1\times10^{4}$ to $1\times10^{8}$ Ω, still more preferably from $1\times10^{5}$ to $1\times10^{7}$ Ω.

The surface resistivity as used here means a surface resistivity defined according to the description in JIS K 6911 (the term "JIS" as used herein means "Japanese Industrial Standard"). More specifically, it is determined by Model P-616 Measuring Electrode manufactured by Kawaguchi Denki Seisakusho KK or Universal Electrometer Model MMII-17A manufactured by Kawaguchi Denki Seisakusho KK.

In the present invention, the back layer may have any structure as long as the surface resistivity thereof is set to fall within the above-described range. The back layer may have a mono-layer structure or a multi-layer structure. The range of the surface resistivity of the back layer can be set, more specifically, by appropriately selecting the kind and amount of an electrically conductive material and the kind and amount of various additives. Examples of the additive include various hydrophilic high polymers, water-resistant materials, water- and organic solvent-resistant materials and synthetic emulsions.

Examples of the electrically conductive material include colloidal alumina, colloidal silica, carbon black, a metal (e.g., Al, Zu, Ag, Fe, Cu, Mn, Co), a metal salt (e.g., chloride, bromide, sulfate, nitrate, oxalate of the metals described above), surfactants (e.g., alkylphosphoric acid alkanol amine salt, polyoxyethylene alkylphosphate, polyoxyethylene alkyl ether, alkylmethyl ammonium salt, N,N-bis(2-hydroxyethyl)alkylamine, alkylsulfonate, alkylbenzenesulfonate, fatty acid choline ester, polyoxyethylene alkyl ether or a phosphoric ester or salt thereof, fatty acid monoglyceride, fatty acid, sorbitan partial ester), a metal oxide (e.g., ZnO, $SnO_2$, $In_2O_3$), cationic high polymer electrolytes, and anionic high polymer electrolytes.

Examples of the cationic high polymer electrolyte include the following:

I. Ammonium

1. Primary, secondary or tertiary ammonium salt

Polyethyleneimine hydrochloride

Poly(N-methyl-4-vinylpyridium chloride)

2. Quaternary ammonium salt

Poly(2-methacryloxyethyltrimethylammonium chloride)

Poly(2-hydroxy-3-methacryloxypropyltrimethylammonium chloride)

Poly(N-acrylamidopropyl-3-trimethylammonium chloride)

Poly(N-methylvinylpyridinium chloride)

Poly(N-vinyl-2,3-dimethylimidazolinium chloride)

Poly(diallylammonium chloride)

Poly(N,N-dimethyl-3,5-methylenepiperidinium chloride)

II. Sulfonium

Poly(2-acryloxyethyldimethylsulfonium chloride)

III. Phosphonium

Poly(glycidyltributylphosphonium chloride) Examples of the anionic high polymer electrolyte include the following:

I. Carboxylate

Poly(meth)acrylic acid

Polyacrylate hydrolysate

Polyacrylic acid amide hydrolysate

Polyacrylic acid nitrile hydrolysate

II. Sulfonate

Polystyrene sulfonate

Polyvinyl sulfonate

III. Phosphonate

Polyvinyl phosphonate

As the electrically conductive material, fine particles of a crystalline oxide or a composite oxide thereof or carbon black is preferably used (see, French Patent 2,277,136, U.S. Pat. No. 3,597,272). In particular, the electrically conductive carbon black is advantageous because it can provide electrically conductive property with a small amount and also has good miscibility with the above-described resin.

The electrically conductive material is used in such an amount that the support has a volume electric resistance in the range specified above. The use amount for giving such a resistance varies depending upon the kind of the additive and the electrically conductive material and cannot be determined definitely, however, as a general standard, it is from 5 to 30% by weight based on the back layer.

In the present invention, an under layer may be provided, if desired, between the electrically conductive support and the photoconductive layer. The under layer has a surface resistivity of preferably from $1\times10^{8}$ to $1\times10^{14}$ Ω, more preferably from $1\times10^{8}$ to $1\times10^{13}$ Ω, still more preferably from $1\times10^{8}$ to $1\times10^{12}$ Ω. By setting the surface resistivity of the under layer to fall within the above-described range, generation of a pin hole, i.e., an area where the toner is not transferred due to spark marks formed upon electric discharge can be prevented and also, generation of fog can be inhibited. The under layer of the present invention may have any structure as long as the surface resistivity thereof can fall within the above-described range. The range of the surface resistivity of the under layer may be controlled in practice by appropriately selecting the kind and amount of the electrically conductive material and the kind and amount of various additives. Examples of the additive include various hydrophilic high polymers, water-resistant materials, water- and organic solvent-resistant materials and synthetic emulsions. Examples of the electrically conductive material and various additives include those described above for the back layer and those described later.

The use amount of the electrically conductive material in the under layer may be within a range that makes the under layer to have a surface resistivity falling within the above-described range. The use amount varies depending upon the kind of various additives and the electrically conductive material and cannot be definitely specified by a specific numeral, however, as a general standard, it is from 0 to 20% by weight of the under layer.

The hydrophilic high polymer for use in the present invention may be any known natural or synthetic hydrophilic high polymer. Specific examples thereof include water-soluble derivatives such as gelatin (e.g., conventional lime-processed gelatin, acid-processed gelatin, modified gelatin, derivative gelatin), albumin, sodium alginate, gum arabic, cellulose (e.g., cellulose, hydroxyethyl cellulose, carboxymethyl cellulose) and starch, and hydrophilic high polymers such as polyvinyl alcohol, polyvinylpyrrolidone, polyacrylamide and styrene-maleic anhydride copolymer, which may be used individually or in combination of two or more thereof. When hydrophilic colloid particles (obtained by forming a hydrophilic material such as silica ($SiO_2$), alumina ($Al_2O_3$) or zeolite into fine particles and stably dispersing the particles in a colloidal form) are added, the mechanical strength is further improved.

The water-resistant material includes a water-resistant film-forming material such as polyvinyl chloride, acrylic resin, polystyrene, polyethylene, alkyd resin, styrene-butadiene copolymer and ethylene-vinyl acetate copolymer, and an organic solvent-resistant film-forming material such as starch, oxidized starch, PVA, methyl cellulose, hydroxyethyl cellulose and CMC.

Examples of the water- and organic solvent-resistant material include ethylene-vinyl alcohol copolymer, high polymerization degree polyester and high polymerization degree polyurethane. Also, a combination of starch, PVA, acrylic resin (reactive acrylic resin either of an organic solvent solution type or an O/W emulsion type) or alkyd resin (of air-curable type) with a crosslinking agent such as melamine resin may be used as a water- and organic solvent-resistant material.

Examples of the synthetic emulsion include those obtained by emulsion-polymerizing or emulsion-copolymerizing a monomer or prepolymer such as acrylate, methacrylate, vinyl chloride, vinylidene chloride, vinyl acetate, polyurethane, acrylonitrile, butadiene or styrene-butadiene.

The materials for the back layer and the under layer may be used in combination. Also, if desired, a dispersant, a leveling agent and a crosslinking agent may be added.

Further, adhesion of the back layer or the under layer can be improved by adding thereto a hydrophilic high polymer binder, for example, an organic titanium compound.

In the present invention, the back layer may have any thickness as long as the capabilities of the layer can be exerted. More specifically, the total thickness of the back layer is generally from 3 to 25 μkm, preferably from 8 to 15 μm. Also, the thickness of the under layer is from 3 to 25 μm, preferably from 8 to 15 μm.

As the electrically conductive support for use in the present invention, any of known water-absorptive supports used in this kind of the electrophotographic printing plate may be used. Examples thereof include a substrate such as paper or plastic sheet, the substrate which has been subjected to electrically conductive treatment, for example, by impregnating it with a low resistance material, the above-described substrate having provided on the surface thereof a water-resistant adhesive layer or at least one or more precoat layer, paper laminated with a plastic which has been made as an electrically conductive substrate by depositing Al or the like thereon, or paper or a plastic sheet laminated with an Al foil.

Specific examples of the electrically conductive substrate or electrically conductive material which can be used for the electrically conductive support used in the present invention include those described in Y. Sakamoto, *Denshishashin* (Electrophotography), 14, No. 1, pp. 2–11 (1975), H. Moriga, *Nyumon Tokusyu-shi no Kaqaku* (Introduction on Chemistry of Special Paper), Kobunshi Kanko Kai (1975), M. F. Hover, *J. Macromol. Sci. Chem.*, A-4(6), pp. 1327–1417 (1970).

As the spectral sensitizing dye for use in the method of the present invention, at least one of the compounds represented by formulae (I) and (II) is used. By using this compound, satisfactory sensitivity to near infrared light or infrared light, good applicability to exposure by scanning, excellent electrophotographic properties without influence of change in the environment and high image quality can be achieved. Also, superior coating solution stability and product stability over prolonged period of time can be ensured.

Preferred embodiments of the compound represented by formula (I) or (II) are described below.

$R_1$, and $R_2$, which may be the same or different, each represents an alkyl group having from 1 to 6 carbon atoms which may be substituted (e.g., methyl, ethyl, propyl, butyl, pentyl, hexyl, 2-methoxyethyl, 3-methoxypropyl, 3-cyanopropyl), an alkenyl group having from 3 to 6 carbon atoms which may be substituted (e.g., allyl, 1-propenyl, 1-methylethenyl, 3-butenyl) or an aralkyl group having from 7 to 9 carbon atoms which may be substituted (e.g., benzyl, phenethyl, 3-phenylpropyl, 1-methylbenzyl, methoxybenzyl, chlorobenzyl, fluorobenzyl, methoxybenzyl).

Also, $R_1$ and $R_2$ each represents a hydrocarbon group constituting a 5-, 6-, 7- or 8-membered alicyclic ring and the alicyclic ring may contain a substituent (e.g., cyclopentyl ring, cyclohexyl ring, cycloheptane ring, methylcyclohexyl ring, methoxycyclohexyl ring, cyclohexene ring, cycloheptene ring).

$X_1$, $X_2$, $X_3$ and $X_4$, which may be the same or different, each represents a hydrogen atom, a carboxy group, a sulfo group, a phospho group, a hydroxy group, a halogen atom (e.g., fluorine, chlorine, bromine), a nitro group, a cyano group, an alkyl group having from 1 to 6 carbon atoms which may be substituted (e.g., methyl, ethyl, propyl, butyl, hexyl, chloromethyl, trifluoromethyl, 2-methoxyethyl, 2-chloroethyl), an aralkyl group having from 7 to 12 carbon atoms which may be substituted (e.g., benzyl, phenethyl, chlorobenzyl, dichlorobenzyl, methoxybenzyl, methylbenzyl, dimethylbenzyl), an aryl group which may be substituted (e.g., phenyl, naphthyl, indenyl, tolyl, xylyl, mesityl, chlorophenyl, dichlorophenyl, ethoxyphenyl, cyanophenyl, acetylphenyl, methanesulfonylphenyl), —O—$R_1$', —S—$R_1$', —C(=O)—$R_1$',—$SO_2$—$R_1$',—OCO—$R_1$',—COO—$R_1$' (wherein $R_1$ ' represents the same group as the aliphatic group represented by $R_1$ or $R_2$, an aryl group which may be substituted (e.g., phenyl, naphthyl, tolyl, xylyl, chlorophenyl, fluorophenyl, methoxyphenyl, bromophenyl, acetylphenyl, acetamidophenyl) or a heterocyclic group (e.g., thienyl, pyridyl, imidazolyl, chlorothienyl, pyrrole)), —CON($R_2$') ($R_3$') or —$SO_2$N($R_2$') ($R_3$') (wherein $R_2$' and $R_3$', which may be the same or different, each represents a hydrogen atom, an alkyl group having from 1 to 8 carbon atoms which may be substituted (e.g., methyl, ethyl, propyl, butyl, hexyl, octyl, 2-chloroethyl, 3-chloropropyl, 3-hydroxypropyl, 2-bromoethyl, 2-hydroxyethyl, 2-sulfoethyl, 2-cyanoethyl, 2-methoxyethyl, 2-ethoxyethyl, 2-carboxyethyl, 3-hydroxypropyl, 2-sulfoethyl, 4-hydroxypropyl, 2-(4-sulfobutyl)ethyl, 2-methanesulfonylethyl, 3-ethoxypropyl, 2,2,2-trifluoroethyl), an alkenyl group having from 2 to 8 carbon atoms which may be substituted (e.g., vinyl, allyl, 3-butenyl, 2-hexenyl, 6-hexenyl), an aralkyl group having from 7 to 12 carbon atoms which may be substituted (e.g., benzyl, phenethyl, chlorobenzyl, methylbenzyl, sulfobenzyl, carboxybenzyl, methoxy-carbonylbenzyl, acetamidobenzyl, methoxybenzyl, dichlorobenzyl, cyanobenzyl, trimethylbenzyl), a phenyl group which may be substituted (e.g., phenyl, tolyl, xylyl, butylphenyl, chloromethylphenyl, methoxyphenyl, ethoxyphenyl, butoxyphenyl, acetamidophenyl, carboxyphenyl, sulfophenyl, trifluoromethylphenyl, chloromethylphenyl) or an organic residue for forming a ring through a hetero atom by combining $R_2$' and $R_3$' (e.g., piperazyl, piperidyl, indolinyl, morpholinyl, isoindolinyl)).

$X_1$ and $X_2$ or $X_3$ and $X_4$ may represent a hydrocarbon group for forming a benzene ring together and the condensed ring formed may contain the same substituent as described above for $X_1$, $X_2$, $X_3$ or $X_4$ .

$Y_1$ represents an alkyl group having from 1 to 18 carbon atoms which may be substituted (e.g., methyl, ethyl, propyl, butyl, pentyl, hexyl, octyl, nonyl, decyl, dodecyl, tridecyl, tetradecyl, hexadecyl, octadecyl, 2-methoxyethyl, 2-ethoxyethyl, 2-(2-methoxyethyloxy)ethyl, 2-hydroxyethyl, 2-(2-hydroxyethylethoxy)ethyl, 3-hydroxypropyl, 6-hydroxyhexyl, 3-cyanopropyl, methoxycarbonylmethyl, 3-ethoxycarbonylpropyl, 4-methoxycarbonylbutinyl, 3-methylcarbonylpropyl, N,N-dimethylaminoethyl, N-methyl-N-benzylaminopropyl, 2-acetoxyethyl, 2-propionyloxyethyl, 2-chloroethyl, 3-chloropropyl, 2,2,2-trichloroethyl, 10-chlorodecyl, carboxymethyl, 2-carboxy-ethyl, 3-carboxypropyl, 4-carboxybutyl, 2-carboxy-propyl, 2-carboxybutyl, 5-carboxypentyl, 2-chloro-3-carboxypropyl, 2-bromo-3-carboxypropyl, 2-hydroxy-3-carboxypropyl, 2-(3'-carboxypropylcarbonyloxy)ethyl, 6-carboxyhexyl, cyclohexylmethyl, 4'-carboxycyclohexylmethyl, methoxycyclointerethyl, 3-(2'-carboxyethylcarbonyloxy) propyl, 2-(2'-carboxyethylcarbamoyl)ethyl, 2-(2'-carboxyethyloxy)ethyl, 2-sulfoethyl, 3-sulfopropyl, 4-sulfobutyl, 2-(3'-sulfopropyloxy)ethyl, 2-(4'-sulfobutyloxy)ethyl, 3-(4'-sulfobutyloxy)propyl, 4-(O'-sulfobenzoyloxy)butyl, 5-sulfopentyl, 8-sulfooctyl, 10-sulfodecyl, 4-(4'-sulfobutyloxy)butyl, 6-(4'-sulfobutyloxy)hexyl, 2-(4'-sulfobutylamino)ethyl, 2-(4'-sulfocyclohexyl)ethyl, 2-phosphoethyl, 2-phosphoxyethyl, 3-phosphoxypropyl, 4-phosphoxybutyl, 3-phosphoxybutyl, 6-phosphoxyhexyl), an alkenyl group having from 2 to 18 carbon atoms which may be substituted (e.g., vinyl, allyl, 3-butenyl, pentenyl, hexenyl, heptenyl, octenyl, decenyl, dodecenyl, octadecenyl, 4-sulfobutenyl, 2-allyloxyethyl, 2-(2'-allyloxyethyloxy)ethyl, 2-allyloxyoxypropyl, 3-(butenylcarbonyloxy)propyl, 2-(2-carboxyethenylcarbonyloxy)ethyl, 4-(allyloxy)butyl) or an aralkyl group having from 7 to 16 carbon atoms which may be substituted (e.g., benzyl, α-methylbenzyl, phenethyl, 3-phenylpropyl, 4-phenylbutyl, chlorobenzyl, bromobenzyl, methylbenzyl, dimethylbenzyl, sulfobenzyl, carboxybenzyl, methoxycarbonylbenzyl, acetamidobenzyl, methoxybenzyl, dichlorobenzyl, cyanobenzyl, trimethylbenzyl, naphthylmethyl, 2-naphthylethyl, 3-naphthylpropyl, 2-(carboxynaphthyl)ethyl, 2-(sulfonaphthyl)ethyl, phosphonoxybenzyl).

Among the groups represented by $Y_1$, the carboxy group, the sulfo group or the phospho group may form a carbonato group, a sulfonato group or a phosphonato group by binding to a cation. The cation is preferably an alkali metal ion (e.g., lithium ion, sodium ion, potassium ion) or an alkaline earth metal ion (e.g., magnesium ion, calcium ion, barium ion).

Further, the carboxy group, the sulfo group or the phospho group may form a salt with an organic base (e.g., pyridine, morpholine, N,N-dimethylaniline, triethylamine, pyrrolidine, piperidine, trimethylamine, diethylmethylamine).

Z represents an oxygen atom, a sulfur atom, a selenium atom, a tellurium atom or a nitrogen atom substituted by a substituent $Y_2$ (wherein $Y_2$ has the same meaning as $Y_1$, above). In each formula, $Y_1$, may be the same with or different from $Y_2$.

n represents 0 or 1.

m represents 2 or 3.

Examples of the heterocyclic ring formed by $W_1$ include a benzothiazole ring, a naphthothiazole ring (e.g., naphtho[2,1-d]thiazole ring, naphtho[1,2-d]thiazole ring), a thionaphthene[7,6-d] ring, a thiazole ring, a benzoxazole ring, a naphthoxazole ring (e.g., naphth[2,1-d]oxazole ring), a selenazole ring, a benzoselenazole ring, a naphthoselenazole ring (e.g., naphtho[2,1-d]selenazole ring, naphtho[1,2-d]selenazole ring), an oxazoline ring, a selenazoline ring, a thiazoline ring, a pyridine ring, a quinoline ring (e.g., 2-quinoline ring, 4-quinoline ring), an isoquinoline ring (e.g., 1-isoquinoline ring, 3-isoquinoline ring), an acrylidine ring, an indolenine ring (e.g., 3,3'-dialkylindolenine ring, cycloalkanespiro-3-indolenine ring, cycloalkanespiro-3'-indolenine ring), a naphthoindolenine ring (e.g., 3,3-dialkylnaphthoindolenine ring) and a benzimidazole ring.

The substituent which the above-described heterocyclic rings may contain includes those described above for $X_1$, $X_2$, $X_3$ and $X_4$.

$W_2$ represents an onium salt of a heterocyclic group as formed in the manner defined for $W_1$.

The methine group represented by $L_1$, $L_2$, $L_3$, $L_4$, $L_5$ or $L_6$ may have a substituent (for example, an alkyl group (e.g., methyl, ethyl, benzyl, 2-sulfoethyl, 2-hydroxyethyl), an aryl group (e.g., phenyl, p-tolyl), a carboxylic acid group, a sulfonic acid group, a cyano group, an amino group (e.g., dimethylamino) or a halogen atom (e.g., F, Cl, Br, I)) or the methine groups may be combined with each other to form a ring. Examples of the ring formed by the methine groups include those represented by the following formulae:

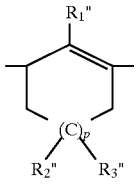

wherein $R_1$" represents a hydrogen atom, a halogen atom (e.g. , F, Cl, Br) or —N($R_1$'")($R_2$'") (wherein $R_1$'" and $R_2$'", which may be the same or different, each represents an alkyl group (e.g., methyl, ethyl, propyl, butyl, benzyl, 2-hydroxyethyl, 2-chloroethyl, 2-sulfoethyl, 2-carboxyethyl) or an aryl group (e.g., phenyl, tolyl, xylyl, methoxyphenyl)), $R_2$"and $R_3$", which may be the same or different, each represents a hydrogen atom, a halogen atom (e.g., F, Cl, Br), an alkyl group (e.g., methyl, ethyl, propyl, butyl, benzyl, phenethyl, 2-hydroxyethyl, 2-chloroethyl, 2-carboxyethyl, 2-methoxycarbonylethyl) or an aryl group (e.g., phenyl, tolyl, xylyl, mesityl, methoxyphenyl), and p represents 0 or 1;

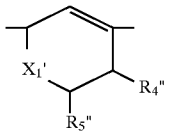

wherein $X_1$' represents a linking group such as —$CH_2$—, —O—, —S— or >N—$R_1$" (wherein $R_1$" has the same meaning as above), $R_4$" and $R_5$", which may be the same or different, each has the same meaning as $R_2$" or $R_3$" above, and $R_4$" and $R_5$" may be combined to form a ring (e.g., cycloheptane ring, cyclohexane ring).

$A_1^-$ represents an anion and examples thereof include a chlorine ion, a bromine ion, an iodine ion, a thiocyanic acid ion, a methylsulfuric acid ion, an ethylsulfuric acid ion, a benzenesulfonic acid ion, a p-toluenesulfonic acid ion, a perchloric acid ion and a boron tetrabromide ion.

n represents 1 or 2 and when the dye molecule includes a sulfone group or a phospho group, an inner salt is formed and n is 1.

Among the spectral sensitizing dyes described above, preferred are dyes where Z is an oxygen atom, a sulfur atom or a nitrogen atom having a substituent $Y_2$.

Also preferred as the spectral sensitizing dye for use in the present invention are compounds containing at least one acidic group, more preferably two or more acidic groups selected from a carboxyl group, a sulfo group and a phospho group in the dye molecule.

By containing the acidic group, adsorptivity of the dye molecule to the photoconductor is elevated, thereby eliminating bad influence on the electrophotographic properties caused by a dye which is not adsorbed but remains in the layer, and also elevating the storage stability of the dye adsorbed in the layer.

Specific examples of the dye of the present invention are set forth below but the scope of the present invention is by no means limited to these.

Compound (1)

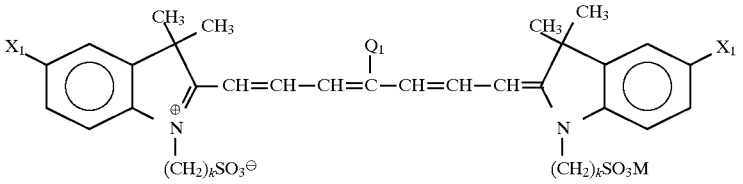

Compound (2)

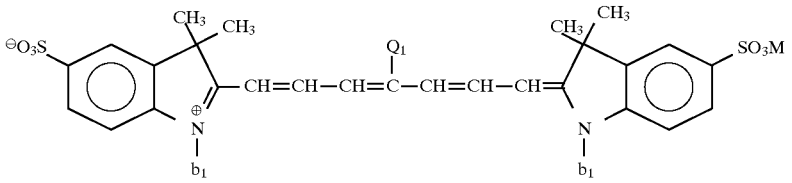

-continued
Compound (3)
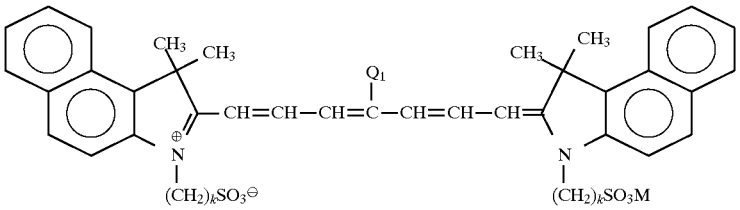
Compound (4)
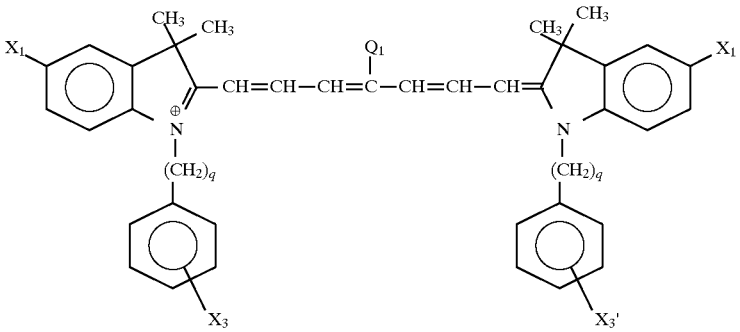
Compound (5)
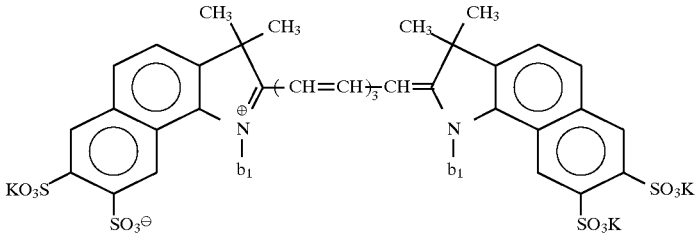
Compound (6)
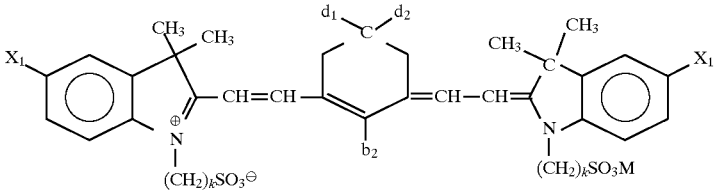
Compound (7)
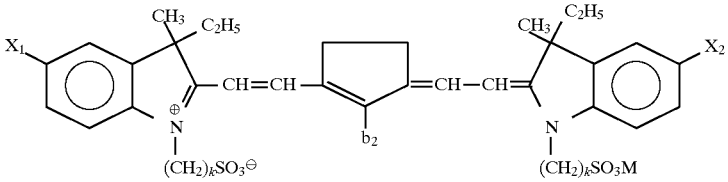
Compound (8)
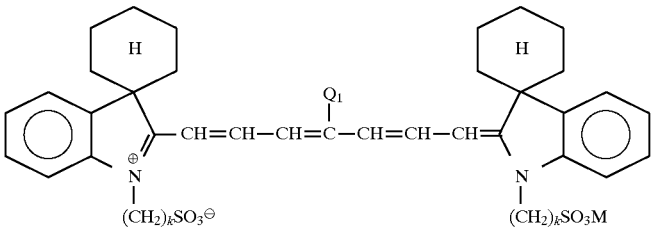
Compound (9)
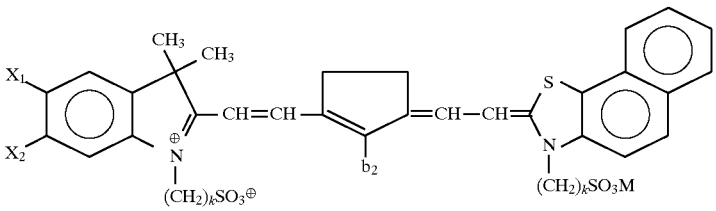

-continued
Compound (10)
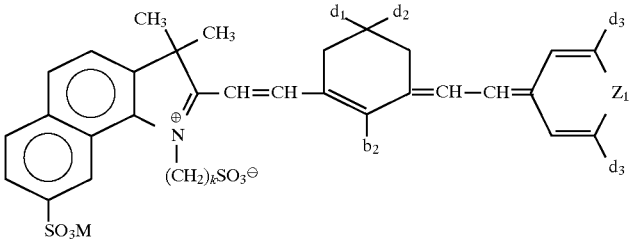
Compound (11)
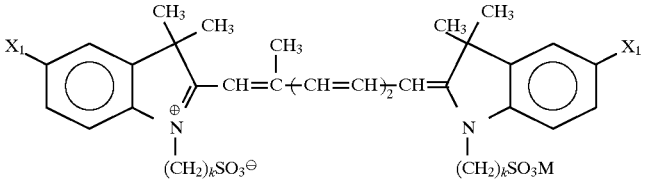
Compound (12)
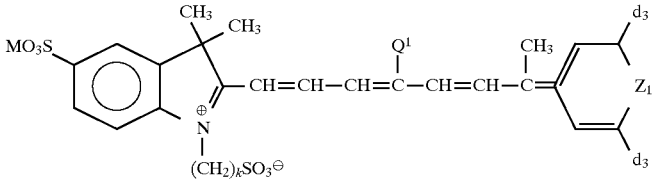
Compound (13)
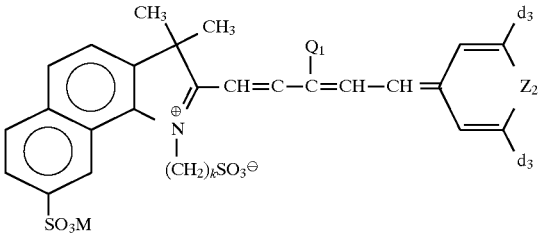
Compound (14)
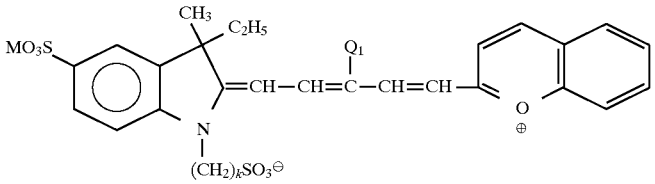
Compound (15)
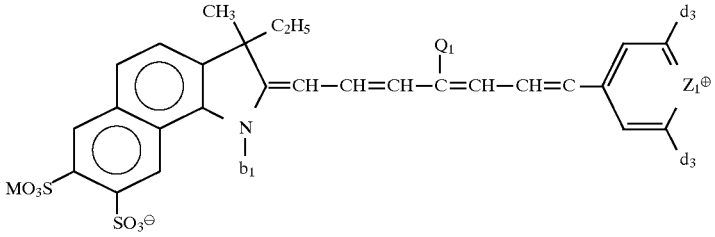
Compound (16)
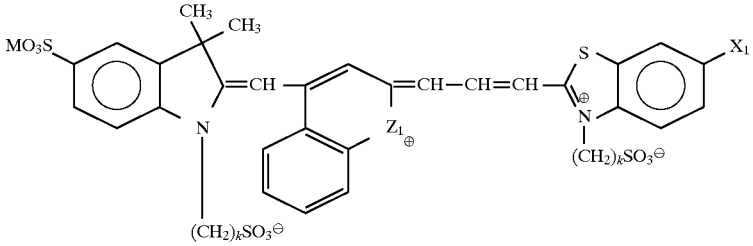

In the above-described specific examples, each substituent has the following meaning:

$Q_1$: —H, $-C_pH_{2p+1}$, $-(CH_2)_pCH{=}CH_2$,

—CH=CH—$CH_3$, 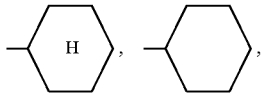

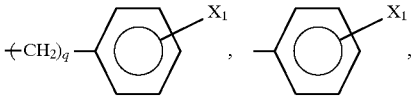

—COOH, —OH, —Cl, —Br, —CN, $-OC_pH_{2p+1}$,

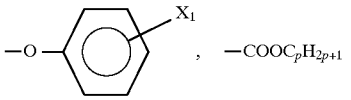

p: an integer of from 1 to 12 q: an integer of from 1 to 3

$X_1$: the same meaning as $Q_1$ above,

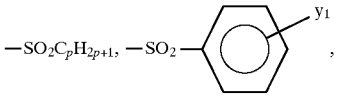

$-COC_pH_{2p+1}$, $-SC_pH_{2p+1}$, $-CONH_2$,

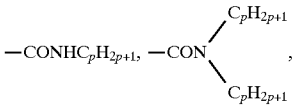

$-SO_2NHC_pH_{2p+1}$, $-SO_3M$, $-NO_2$, $-PO_3H_2$ (wherein $y_1$ a is —H, $-C_pH_{2p+1}$, —Cl, —Br, —F, —OH, $-OC_pH_{2p+1}$, $-COOC_pH_{2p+1}$, —CN (p is an integer of from 1to 12))

M: —H, —Na, —K, $-H.N(C_2H_5)_3$,

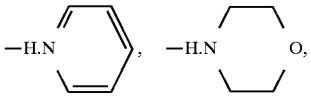

k: an integer of from 2 to 12

$b_1$: $-C_pH_{2p+1}$, $(CH_2)_pCH{=}CH_2$, —CH=CH—$CH_3$,

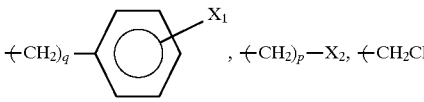

$(CH_2CH_2O)_{r1}C_pH_{2p+1}$, $(CH_2CH_2O)_{r1}(C_3H_6O)_{r2}H$, $(C_3H_6O)_{r1}(C_2H_2O)_{r1}C_pH_{2p+1}$ wherein $X_2$: —OH, —Cl, —Br, —F, —CN, —COOH, $-COOC_pH_{2p-1}$, $-SO_3M$, $-PO_3H_2$, $r_1$, $r_2$: which may be the same or different, each represents an integer of from 1 to 6

$X_3$: $-SO_3^{\ominus}$, $-PO_3H^{\ominus}$ $X_3'$: $-SO_3M$, $-PO_3M_2$ $b_2$: —H, $-C_qH_{2q+1}$, —Cl, —Br, $-N(C_qH_{2q+1})_2$, $d_1$, $d_2$: which may be the same or different, each represents —H, $-C_qH_{2q+1}$ $Z_1$: —O—, —S—

$d_3$: $-C_pH_{2p+1}$, $-C_6H_5$ $Z_2$: —Se—, —Te—

The above-described spectral sensitizing dyes for use in the present invention may be produced according to conventionally known methods, for example, the method described in JP-A-57-46245. Other various methods are described in F. M. Hamer, *The Cyanine Dyes and Related Compounds*, John Wiley & Sons, New York (1964).

Examples of the inorganic photoconductor for use in the image formation method of the present invention include zinc oxide, titanium oxide, zinc sulfide, cadmium sulfide, zinc selenide, cadmium selenide and lead sulfide. The photoconductor may of course be a photoconductor processed as described in H. Miyamoto and H. Takei, *Imejinqu* (Imaging), 1973 (No. 8).

As the chemical sensitizer for use in the present invention, any compound known as a chemical sensitizer of an inorganic photoconductor may be used and the compounds may be used individually or in combination of two or more.

A conventionally known chemical sensitizer of a photoconductive zinc oxide or titanium oxide is an electron-accepting compound (or electron affinitive compound) and specific examples thereof include the compounds described in publications or general remarks such as H. Miyamoto and H. Takei, *Imejinqu* (Imaging), No. 8, pp. 6 and 12 (1973), H. Kiess, *Progress in Surface Science,* 9, 113 (1979), I. Shinohara, *Kiroku Zairyo to Kankosei Jushi* (Recording Material and Photosensitive Resin), Chap. 3, Gakkai Shuppan Center KK (1979), E. Inoue, *Kagaku to Kogyo* (Chemistry and Industry), 23, 158 (1970).

More specifically, examples of the compound include a quinone (e.g., benzoquinone, chloranil, fluoranil, bromanil, anthraquinone, 2-methylanthraquinone, 2,5-dichlorobenzoquinone, 2-sulfobenzoquinone, 2-butylquinone, 2,5-dimethylbenzoquinone, 2,3-dichloro-5,6-dicyanobenzoquinone, 2-methanesulfonylbenzoquinone), a cyano group or nitro group-containing compound (e.g., nitrobenzene, dinitrobenzene, dinitrofluorenone, trinitrofluorenone, tetracyanoethylene, nitronaphthalene, dinitronaphthalene, nitrophenol, cyanophenol, dinitrophenol, dicyanophenol), an aliphatic carboxylic acid which may contain a substituent (e.g., lauric acid, stearic acid, linoleic acid, linolenic acid, fumaric acid, maleic acid, adipic acid, glutaric acid, malic acid, lactic acid, tartaric acid, trichloroacetic acid, dichloroacetic acid, chloropropionic acid, dimethylmaleic acid, chloromaleic acid, dichloromaleic acid, chlorofumaric acid, phenylpropionic acid, amino acids), an aromatic carboxylic acid (e.g., benzoic acid, phthalic acid, pyromellitic acid, mellitic acid, naphthalenecarboxylic acid, 3,3',4,4'-benzophenonetetracarboxylic acid, a carboxylic acid further containing other substituent (examples of the substituent include a hydroxy group, a mercapto group, a halogen atom, a cyano group, a nitro group, a trifluoromethyl group, an alkyl group, an alkoxy group, a phenoxy group, an acyl group, an acetamido group, a methanesulfonyl group, an alkoxycarbonyl group, an amino group and a plurality of substituents, which may be the same or different, may be contained)), an organic acid cyclic acid anhydride (examples of the organic acid cyclic anhydride include a cyclic anhydride of an aliphatic dicarboxylic acid which may be substituted (e.g., succinic anhydride, 2-methylsuccinic anhydride, 2-ethylsuccinic anhydride, 2-butylsuccinic anhydride, 2-octylsuccinic anhydride, decylsuccinic anhydride, 2-dodecylsuccinic anhydride, 2-octadecylsuccinic anhydride, maleic anhydride, methylmaleic anhydride, dimethylmaleic anhydride, phenylmaleic anhydride, chloromaleic anhydride, dichloromaleic anhydride, fluoromaleic anhydride, difluoromaleic anhydride, bromomaleic anhydride, itaconic anhydride, citraconic anhydride, glutaric anhydride, adipic anhydride, diglycolic anhydride, pimelic anhydride, suberic anhydride, cie-5-norbornene-endo-2,3-dicarboxylic acid, d-campholinic anhydride, 3-oxabicyclo[3,2,2]nonane-2,4-dione, 1,3-dioxorane-2,4-dione) and an αamino acid-N-carboxylic anhydride (examples of the α-amino acid as a starting material include glycine, N-phenolglycine, alanine, β-phenylalanine, valine, leucine, isoleucine, α-aminophenylacetic acid, α-aminocaprylic acid, α-aminolauric acid, γ-benzylglutamic acid, sarcosine)) and an aromatic cyclic acid anhydride (e.g., phthalic anhydride, nitrophthalic anhydride, dinitrophthalic anhydride, methoxyphthalic anhydride, methylphthalic anhydride, chlorophthalic anhydride, cyanophthalic anhydride, dichlorophthalic anhydride, tetrachlorophthalic anhydride, tetrabromophthalic anhydride, O-sulfobenzoic anhydride, 3,3',4,4'-benzophenonetetracarboxylic dianhydride, phthalonic anhydride, pyromellitic anhydride, mellitic anhydride, pulvinic anhydride, diphenic anhydride, thiophenedicarboxylic anhydride, furanedicarboxylic anhydride, 1,8-naphthalenedicarboxylic anhydride, pyrroledicarboxylic anhydride).

Further, N-hydroxyimido compounds described in JP-A-3-136061, acylhydrazone derivatives, triazole derivatives, imidazolone derivatives, imidathione derivatives and benzimidazole derivatives described in JP-A-51-124933, amide compounds having a specific structure described in JP-A-58-102239, polyarylalkane compounds, hindered phenol compounds and p-phenylenediamine compounds described in general remarks of H. Kokado et al., *Saikin no Hikaridoden Zairyo to Kankotai no Kaihatsu•Jitsuyoka* (Recent Developments and Practical Use of Photoconductive Material and Photosensitive Material), Chaps. 4 to 6, Nippon Kagaku Joho KK, Shuppan-bu (1986), and compounds described in JP-A-58-65439, JP-A-58-129439 and JP-A-62-71965 are included.

In the present invention, a plasticizer may be added to the photoconductive layer and examples of the plasticizer include dimethyl phthalate, dibutyl phthalate, dioctyl phthalate, triphenyl phthalate, triphenyl phosphate, diisobutyl adipate, dimethyl sebacate, dibutyl sebacate, butyl laurate, methylphthalylethyl glycolate and dimethylglycol phthalate. The plasticizer may be added to improve flexibility of the photoconductive layer. The plasticizer may be added in such an amount that the electrostatic properties of the photoconductive layer is not deteriorated.

The binder resin which can be used in the photoconductive layer of the present invention may be any known resin conventionally used in the electrophotographic photosensitive material. The weight average molecular weight of the resin is preferably from $1\times10^3$ to $1\times10^6$, more preferably from $1\times10^4$ to $1\times10^5$. The glass transition point of the binder resin is preferably from −40 to 200° C., more preferably from −10 to 140° C.

Examples of the known binder resin for use in the photoconductive layer include compounds described in publications or general remarks such as R. Shibata and J. Ishiwatari, *Kobunshi* (High Molecular Material), Vol. 17, p. 278 (1968); H. Miyamoto and H. Takei, *Imejinqu* (Imaging), 1973 (No. 8); K. Nakamura (compiler), *Kiroku Zairyo yo Binder no Jissai Gijutsu* (Practical Technique of Binder for Recording Material), Chap. 10, C.M.C. Shuppan (1985); *Denshi-shashin yo Yuki Kankotai no Genjo Simpojiumu Yokoshu* (Symposium on Organic Photosensitive Material for Electrophotography, Minute Collection), Denshi-shashin Gakkai (compiler) (1985); H. Kokado (compiler), *Saikin no Hikaridoden Zairyo to Kankotai no Kaihatsu•Jitsuyoka*, Nippon Kagaku Joho KK (1986); *Denshi-shashin Gijutsu no Kiso to Oyo* (Basic and Application of Electrophotograph Technology), Chap. 5, Denshi-shashin Gakkai (compiler), Corona Sha KK (1988); D. Tatt and S. C. Heidecker, *Tappi,* 49 (No. 10), 439 (1966); E. S. Baltazzi, R. G. Blanclotteet et al., *Phot. Sci. Eng.,* 16 (No. 5), 354 (1972); and Guene Chan Cay, I. Shimizu and E. Inoue, *Denshi-shashin Gakkai Shi,* 18 (No. 2), 22 (1980).

Specific examples of the binder resin include an olefine polymer or copolymer, a vinyl chloride copolymer, a vinylidene chloride copolymer, an alkane acid vinyl polymer or copolymer, an alkane acid allyl polymer or copolymer, a polymer or copolymer of styrene or a derivative thereof, a butadiene-styrene copolymer, an isoprene-styrene copolymer, a butadiene-unsaturated carboxylate copolymer, an acrylonitrile copolymer, a methacrylonitrile copolymer, an alkyl vinyl ether copolymer, an acrylate polymer or copolymer, a methacrylate polymer or copolymer, a styrene-acrylate copolymer, a styrene-methacrylate copolymer, an itaconic acid diester polymer or copolymer, a maleic anhydride copolymer, an acrylamide copolymer, a methacrylamide copolymer a hydroxyl group-modified silicone resin, a polycarbonate resin, a ketone resin, a polyester resin, a silicone resin, an amido resin, a hydroxyl group- and carboxyl group-modified polyester resin, a butyral resin, a polyvinylacetal resin, a cyclized rubber-methacrylate copolymer, a cyclized rubber-acrylate copolymer, a copolymer containing a nitrogen-free heterocyclic ring (examples of the heterocyclic ring include a furan ring, a tetrahydrofuran ring, a thiophene ring, a dioxane ring, a dioxofuran ring, a lactone ring, a benzofuran ring, a benzothiophene ring and a 1,3-dioxetane ring) and an epoxy resin.

More specifically, conventionally known resins described in T. Endo, *Netsukokasei Kobunshi no Seimitsuka* (Precisionize of Heat-curable Polymer), CMC. KK (1986), Y. Harasaki, *Saishin Bainda Gijutsu Binran* (Newest Binder Handbook), Chap. II-1, Sogo Gijutsu Center (1985), T. Ohtsu, *Akuriru Jushi no Gosei•Sekkei to Shin-yoto Kaihatsu* (Synthesis, Design and Development of New Application of Acryl Resin), Chubu Keiei Kaihatsu Center Shuppan-bu (1985) and E. Ohmori, *Kinousei Akuriru Kei Jushi* (Functional Acryl Resins), Technosystem (1985) may be used.

In particular, when a resin containing an acidic group such as a carboxyl group, a sulfo group or a phosphono group and having a relatively low molecular weight (approximately from $10^3$ to $10^4$) is used as the binder resin in the photoconductive layer, the electrostatic characteristics can be improved. Examples of the resin include a resin comprising acidic group-containing polymer components randomly present in the polymer main chain as described in JP-A-63-217354, a resin comprising an acidic group bonded to one terminal of the polymer main chain as described in JP-A-64-70761, a resin comprising an acidic group bonded to the main chain terminal of a graft-type copolymer and a resin containing an acidic group in the graft moiety of a graft-type copolymer as described in JP-A-2-67563, JP-A-2-236561, JP-A-2-238458, JP-A-2-236562 and JP-A-2-247656 and an A-B type block copolymer containing an acidic group as block described in JP-A-3-181948.

Further, in order to achieve sufficiently high mechanical strength of the photoconductive layer which may not be available only by the above-described low molecular weight resin, other resin having a middle or high molecular weight is preferably used in combination. Examples of such a resin include a thermosetting resin having a cross-linking structure formed between polymers as described in JP-A-2-68561, a resin partly having a cross-linking structure as described in JP-A-2-68562 and a resin comprising an acidic group bonded to the main chain terminal of a graft-type copolymer as described in JP-A-2-69759. Further, by using a specific middle or high molecular weight resin, properties can be maintained stably even when the environment changes greatly. Examples of the resin include a resin comprising an acidic group bonded to the terminal of the graft moiety of a graft-type copolymer and a resin having an acidic group in the graft moiety of a graft-type copolymer as described in JP-A-3-29954, JP-A-3-77954, JP-A-3-92861 and JP-A-3-53257 and a graft-type copolymer containing an A-B block-type copolymer consisting of A block containing an acidic group and B block containing no acidic group in the graft moiety as described JP-A-3-206464 and JP-A-3-223762. By using the specific resin, the photoconductor can be dispersed uniformly, the photoconductive layer having good smoothness can be formed and, further, excellent electrostatic properties can be maintained even when the environment changes.

In general, the amount of the binder resin to be incorporated into the composition for the photoconductive layer of the present invention can be changed, and typically it is from about 10 to about 90% by weight, preferably from 15 to 60% by weight, based on the total amount of the mixture of the photoconductive material and the resin.

The sensitizing dye may be used in the present invention with reference to any conventionally known method. In particular, advantageous methods include a method where a photoconductor is dispersed in a binder resin and a dye solution is added thereto and a method where a photoconductor is previously poured in a dye solution to adsorb the dye and the solution is then dispersed in a binder resin. The use amount of the sensitizing dye in the present invention varies over a wide range in view of the level of sensitivity required. Namely, the sensitizing dye may be used in an amount of from 0.0005 to 2.0 parts by weight per 100 parts by weight of the photoconductor and it is preferably used in an amount of from 0.001 to 1.0 part by weight per 100 parts by weight of the photoconductor.

The chemical sensitizer may be used in the present invention according to any of a method where a powder or solution of the chemical sensitizer is used together with the above-described sensitizing dye, a method where it is added before adding the dye and a method where a photoconductor is previously mixed with the chemical sensitizer and a binder and/or dye is added and dispersed therein, but a method where a photoconductor and a chemical sensitizer are previously processed is preferred.

The use amount of the chemical sensitizer in the present invention may be from 0.0001 to 1.0 part by weight per 100 parts by weight of the photoconductor. If it is less than this range, effects cannot be provided on the electrostatic charge property, the dark-charge receptivity and the sensitizing property, whereas if it exceeds the range, an apparent sensitivity is increased but the dark-charge receptivity is reduced remarkably.

The sensitizing dyes and the chemical sensitizing dyes for use in the present invention can be incorporated into the photosensitive layer individually or in combination of two or more thereof. Further, although the sensitizing dye of the present invention is spectrally sensitized to near infrared or infrared light, it is of course possible to use a conventionally known spectral sensitizing dye for visible light (e.g., Fluorescene, Rose Bengal, Rhodamine B, cyanine dyes such as monomethine, trimethine and pentamethine or merocyanine dyes) in combination depending upon the purpose.

When conventionally known various additives for the photoconductive layer are further used, the addition amount may be freely selected as long as the effect of the present invention is not inhibited, however, it is usually from 0.0005 to 2.0 parts by weight per 100 parts by weight of the photoconductor.

As an organic solvent used in dispersion, a volatile hydrocarbon solvent having a boiling point of 200° C. or lower is used and in particular, a hydrocarbon halide having from 1 to 3 carbon atoms such as dichloromethane, chloroform, 1,2-dichloroethane, tetrachloroethane, dichloropropane or trichloroethane is preferred. In addition, various solvents for use in coating compositions such as an aromatic hydrocarbon (e.g., chlorobenzene, toluene, xylene, benzene), a ketone (e.g., acetone, 2-butanone), an ether (e.g., tetrahydrofuran) and a methylene chloride or a mixture with the above-mentioned solvent(s) can be used. The solvent is added in an amount of from 1 to 100 g, preferably from 5 to 20 g, per 1 g of the total amount of the dye, the photoconductive material and other additives.

The coating thickness of the composition for the photoconductive layer may be varied over a wide range. The composition may be usually coated in a thickness (before drying) of from about 10 to about 300 $\mu$m, but the coating thickness before drying is preferably from about 50 to about 150 $\mu$m. However, even if the thickness is outside this range, an effective result may be obtained. The dry thickness of the coating is sufficient if it is within the range of from about 1 to about 50 $\mu$m.

The photoconductive layer composition for use in the present invention can be used not only as a photosensitive layer (photoconductive layer) of a monolayer-type electrophotographic photosensitive material but also as a charge carrier generation layer of a function separated-type electrophotographic photosensitive material comprising two layers, i.e., a charge carrier generation layer and a charge carrier transportation layer or as a photoconductive photosensitive particle or a photoconductive composition to be contained therein in photoelectrophoretic electrophotography.

When the photoconductive layer is used as a charge generation layer of a multilayer-type photosensitive material comprising a charge generation layer and a charge transportation layer, the thickness of the charge generation layer is preferably from 0.01 to 5 $\mu$m, more preferably from 0.05 to 2 $\mu$m.

The electrophographic photosensitive material of the present invention described in the foregoing is processed into a lithographic printing plate through usual steps such as electrostatic charging, imagewise exposure and development. Further, the material is suitable for the development in a direct feeding system which will be described later.

The imagewise exposure applied to the present invention is scanning exposure. In particular, laser exposure is preferred.

In the present invention, the laser beam recording is conducted by converging laser beams emitted from a gas laser such as He-Cd or He-Ne or a semiconductor laser such as GaAlAs through an fθ lens and forming a scanning image on a photosensitive material by means of a polygon mirror. In case of a gas laser, it is necessary to use a light modulator, whereas the semiconductor laser is advantageous in that it is compact and lightweight as compared with the gas laser and requires no modulator, thus, the semiconductor laser is being used in practice. However, the GaAlAs semiconductor laser in practical use emits laser beams having an oscillation wavelength of about 780 nm and accordingly, the photoconductive layer composition used must be sensitive to laser beams of this wavelength.

In laser beam scanning recording, when plane scanning is conducted by deflecting laser beams using a rotary mirror, the scanning speed becomes a function of the polarizing angle thereby causing distortion in printing and accordingly, an fθ lens or the like is used in the optical system to improve linearity. It is also possible to use a polygon mirror having curvature on the reflecting surface in place of the fθ lens so as to eliminate the scanning distortion. Other scanning methods may be used, for example, a method where the mirror is moved in parallel or a method where a plurality of mirrors are used may be employed.

In the present invention, the development may be made by any wet development method, however, it is preferred to use the method of the present invention based on the principle view of a direct feeding system shown in FIG. 1.

In this development method, as shown in FIG. 1, a conductor 1 is brought into contact with the surface 2 of a back layer, the surface 3 of a photoconductive layer is put to face an electrode 4, a voltage is applied between the electrode 4 and the conductor 1 in the manner that the electrode 4 and the conductor 1 respectively become a positive electrode and a negative electrode, and the positive charge on the surface 2 of the back layer is swiftly neutralized according to the necessity by electrons directly fed from the conductor 1 or an earth 5 and, as a result thereof, the toner (+) is smoothly attached to the photoconductive layer 3 (−) and then neutralized.

Due to this action, a so-called solid image can be completely free of area where the toner is not attached, whereby a more uniform solid image can be obtained and the development speed can be expedited.

The present invention will be described below in greater detail by referring to the Examples, however, the present invention should not be construed as being limited thereto.

EXAMPLE 1

Preparation of Compositions A to G:

Composition A for an under layer or a back layer was prepared according to the following formulation (1):

| Formulation (1) | |
|---|---|
| SBR Latex (50 wt % water dispersion) | 92 parts by weight |
| Starch (40 wt % aqueous solution) | 58 parts by weight |
| Clay (45 wt % water dispersion) | 110 parts by weight |
| Melamine (80 wt % aqueous solution) | 5 parts by weight |
| Carbon black | 2.5 parts by weight |
| Water | 179 parts by weight |

Composition A was coated on a PET support to form a film (thickness: 10 μm) and the surface resistivity determined thereon is shown in Table 1. The surface resistivity was determined here using a measuring electrode apparatus Model P-616 manufactured by Kawaguchi Seisakusho KK.

Compositions B to G were prepared according to the following formulation (2) by varying the addition amount of carbon black in the manner shown in Table 1 and each composition was coated as a film in the same manner as Composition A to obtain 6 kinds of samples comprising Compositions B to G different in the surface resistivity. The surface resistivity was determined on each sample in the same manner as in the film using Composition A. The addition amount of carbon black in respective compositions and surface resistivity of each film are shown in Table 1.

| Formulation (2) | |
|---|---|
| SBR Latex (50 wt % water dispersion) | 92 parts by weight |
| Clay (45 wt % water dispersion) | 110 parts by weight |
| Melamine (80 wt % aqueous solution) | 5 parts by weight |
| Carbon black | described in Table 1 |
| Water | 191 parts by weight |

TABLE 1

| Back Layer | Composition | Addition Amount of Carbon Black (part by weight) | Surface Resistivity (Ω) |
|---|---|---|---|
| a | A | 2.5 | $8 \times 10^{11}$ |
| b | B | 10.3 | $2 \times 10^{10}$ |
| c | C | 13.6 | $7 \times 10^{9}$ |
| d | D | 19.2 | $4 \times 10^{8}$ |
| e | E | 25.7 | $3 \times 10^{7}$ |
| f | F | 31.1 | $4 \times 10^{6}$ |
| g | G | 38.3 | $2 \times 10^{5}$ |

Preparation of Electrophotographic Lithographic Printing Plate:

A wood free paper weighed 100 g/m$^2$ was used as a support and one side thereof was coated with the above-described Composition A so as to give a dry coating amount of 10 g/m$^2$ to form thereby an under layer (surface resistivity: $8\times10^{11}$ Ω). Then, the surface of the support opposite to the under layer was coated with Composition A, B, C, D, E, F or G so as to give a dry coating amount of 10 g/m$^2$ to form thereby a back layer. Thus, seven kinds of supports having an under layer and a back layer were obtained. The under layer surface of respective supports was coated with a composition for the photoconductive layer shown in the following formulation (3) so as to give a dry coating amount of 30 g/m$^2$ to prepare various electrophotographic lithographic printing plate.

| Formulation (3) | |
|---|---|
| Photoconductive zinc oxide (SAZEX 2000 produced by Sakai Kagaku Kogyo KK) | 100 parts by weight |
| Binder Resin (B-1) shown below | 17 parts by weight |
| Binder Resin (B-2) shown below | 3 parts by weight |
| Salicylic acid | 0.15 part by weight |
| Phthalic anhydride | 0.15 part by weight |
| Sensitizing Dye (S-1) shown below | 0.015 part by weight |
| Methanol | 10 parts by weight |
| Toluene | 150 parts by weight |

Binder Resin (B-1)

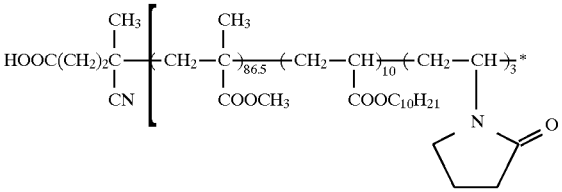

Mw $8 \times 10^4$ (by weight)

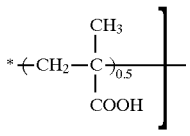

-continued

Binder Resin (B-2)

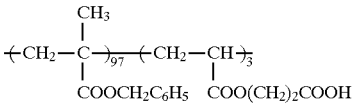

Mw 6 × $10^3$

Sensitizing Dye (S-1)

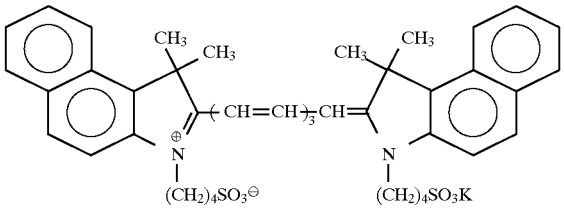

The thus-obtained seven kinds of electrophotographic lithographic printing plates were evaluated for their capabilities as follows.

(Electrophotographic Properties)

Each electrophotographic lithographic printing plate was subjected to corona charging at −6 kV according to a static system using a paper analyzer Model SP-428 (manufactured by Kawaguchi Denki KK) and after holding it in the dark for 60seconds, exposed and examined on the electrostatic charging properties. The electrostatic charging properties were determined by measuring the initial charge potential ($V_0$), the retentive degree of the electric potential after reduced in dark for 60 seconds in comparison with the initial potential ($V_0$) (i.e., the charge receptivity in dark (RDD (%)), and the exposure amount needed to reduce the surface potential obtained by corona discharging at −400 V from the initial value to the half (i.e., the half exposure (E½ (erg/$cm^2$)). The light source used was a gallium-aluminum-arsenic semiconductor layer (oscillation wavelength: 780 nm). The results obtained are shown in Table 2. Also, the environmental conditions in evaluating the electrophotographic properties were changed variously as shown in Table 2 and the results obtained are also shown in Table 2 below.

TABLE 2

| Sample | Back | 15° C., 30% RH | | | 20° C., 60% RH | | | 30° C., 70% RH | | |
|---|---|---|---|---|---|---|---|---|---|---|
| No. | Layer | $V_0$ | DRR | $E_{1/2}$ | $V_0$ | DRR | $E_{1/2}$ | $V_0$ | DRR | $E_{1/2}$ |
| 1 | a | −660 | 93 | 45 | −630 | 93 | 33 | −550 | 88 | 28 |
| 2 | b | −650 | 93 | 40 | −625 | 92 | 31 | −555 | 89 | 28 |
| 3 | c | −630 | 91 | 35 | −635 | 94 | 30 | −540 | 90 | 27 |
| 4 | d | −625 | 91 | 37 | −640 | 93 | 29 | −535 | 90 | 28 |
| 5 | e | −630 | 91 | 36 | −650 | 93 | 30 | −525 | 90 | 29 |
| 6 | f | −620 | 91 | 34 | −640 | 92 | 29 | −540 | 90 | 30 |
| 7 | g | −635 | 91 | 32 | −650 | 92 | 30 | −535 | 89 | 31 |

(Image Reproductivity)

Each of the resulting electrophotographic lithographic printing plate was charged and subjected to image exposure and then to wet development in a direct feeding system where a steel-made conductor was brought into contact with the back layer of the plate in a testing machine according to the principle shown in FIG. 1 was conducted using a plate-making machine ELP330X manufactured by Fuji Photo Film Co., Ltd. The image exposure was conducted using an original having pasted in the center thereof a black sheet in a size of 185 mm×257 mm (B5 size) so as to examine the uniformity of solid image. Each of the resulting samples was measured on the solid image density by a Macbeth densitometer and evaluated on the uniformity. The environmental conditions in plate making were varied as shown in Table 3.

TABLE 3

| | Solid Image Uniformity | | |
|---|---|---|---|
| Sample No. | 15° C., 30% RH | 20° C., 60% RH | 30° C., 70% RH |
| 1 | C | C | C |
| 2 | C | B | B |
| 3 | A | A | A |
| 4 | A | A | A |
| 5 | A | A | A |
| 6 | A | A | A |
| 7 | A | A | A |

The criteria for evaluation on the uniformity of the solid image density in Table 3 are as follows:

A: The difference in density between the maximum density part and the minimum density part was 0.05 or less.

B: The difference in density between the maximum density part and the minimum density part was from 0.06 to 0.99.

C: The difference in density between the maximum density part and the minimum density part was 1.00 or more.

As shown in Tables 2 and 3, the samples of the present invention did not depend on the environment, showed good electrophotographic properties such as the initial electrical potential, the charge receptivity in dark and the half exposure and also were excellent in the uniformity of image density.

EXAMPLE 2

Electrophotographic lithographic printing plates were prepared in the same manner as in Example 1 except for using the composition having the following formulation in place of the photoconductive layer used in Example 1 and evaluation on various properties was conducted in the same manner as in Example 1. The results obtained are shown in Table 4.

Formulation:

| | |
|---|---|
| Photoconductive zinc oxide (SAZEX 2000 produced by Sakai Kagaku Kogyo KK) | 100 parts by weight |

-continued

| | |
|---|---|
| Binder Resin (B-3) shown below | 17 parts by weight |
| Binder Resin (B-4) shown below | 3 parts by weight |
| Sensitizing Dye (S-2) shown below | 0.013 part by weight |
| Maleic anhydride | 0.15 part by weight |
| N-Hydroxyphthalimido | 0.20 part by weight |
| Methanol | 10 parts by weight |
| Toluene | 150 parts by weight |

Binder Resin (B-3)

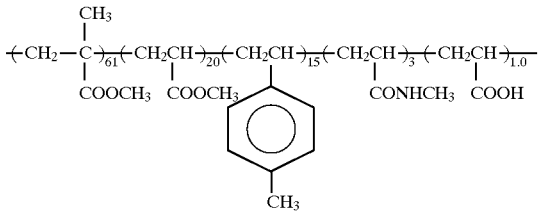

Mw 7 × $10^4$

Binder Resin (B-4)

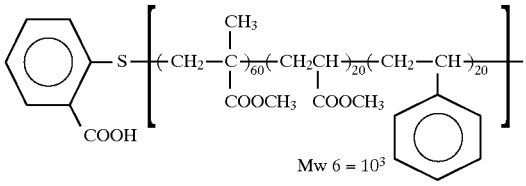

Mw 6 = $10^3$

Sensitizing Dye (S-2)

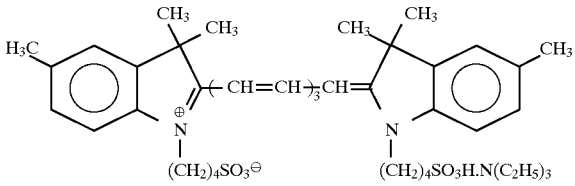

TABLE 4

| Sample | Back | 15° C., 30% RH | | | 20° C., 60% RH | | | 30° C., 70% RH | | |
|---|---|---|---|---|---|---|---|---|---|---|
| No. | Layer | $V_0$ | DRR | $E_{1/2}$ | $V_0$ | DRR | $E_{1/2}$ | $V_0$ | DRR | $E_{1/2}$ |
| 8 | a | −580 | 94 | 42 | −560 | 93 | 38 | −520 | 87 | 32 |
| 9 | b | −570 | 94 | 44 | −565 | 93 | 37 | −525 | 88 | 32 |
| 10 | c | −565 | 92 | 36 | −560 | 94 | 32 | −520 | 90 | 30 |
| 11 | d | −560 | 91 | 35 | −555 | 93 | 30 | −510 | 90 | 29 |
| 12 | e | −545 | 91 | 33 | −560 | 93 | 29 | −505 | 90 | 30 |
| 13 | f | −550 | 91 | 35 | −560 | 92 | 30 | −515 | 90 | 32 |
| 14 | g | −555 | 91 | 32 | −565 | 94 | 31 | −520 | 90 | 30 |

As clearly seen from the results in Table 4, the samples of the present invention were independent to the environment similarly in Example 1 and had good electrophotographic properties. Further, when the uniformity of the image density was evaluated in the same manner as in Example 1, the results were also good.

Each printing plate was subjected to degreasing treatment with an etching solution (produced by Andolesograf Multigraf) and printing was conducted in an off-set printing machine Hamatastar 700, as a result, 10,000 or more printed matters having good image quality reproducing the solid image uniformity and thin line sharpness achieved were obtained by each plate.

EXAMPLE 3

An electrophotographic lithographic printing plate of the present invention was prepared by coating the support having the back layer (d) in Table 1 of Example 1 with a composition for the photoconductive layer having the following formulation so as to give a dry coating amount of 26 g/$m^2$.

| Formulation: | |
|---|---|
| Photoconductive zinc oxide (SAZEX 2000, produced by Sakai Kagaku Kogyo) | 100 parts by weight |
| Binder Resin (B-5) shown below | 16 parts by weight |
| Binder Resin (B-6) shown below | 4 parts by weight |
| Sensitizing Dye (S-3) shown below | 0.02 part by weight |
| Chloromaleic anhydride | 0.25 part by weight |
| N-Hydroxyphthalimido | 0.20 part by weight |
| Methanol | 10 parts by weight |
| Toluene | 150 parts by weight |

COMPARATIVE EXAMPLE 1

An electrophotographic lithographic printing plates were prepared in the same manner as in Example 3 except for using Dye (A) shown below in place of Sensitizing Dye (S-3) in Example 3.

Each sample was charged, exposed and processed into a plate in the same manner as in Example 1 except for changing the environmental conditions in the electrophotographic processing and plate-making process to conditions (15° C., 20% RH), (20° C., 60% RH) or (30° C., 80% RH) and various evaluations on the image was conducted in the same manner as in Example 1. The results obtained are shown in Table 5 below.

Further, in order to examine the storage stability, samples of Example 3 and Comparative Example 1 were allowed to stand in the conditions (30° C., 80% RH) for 24 hours and evaluation was made thereon. The results are also shown in Table 5 below.

Binder Resin (B-5)

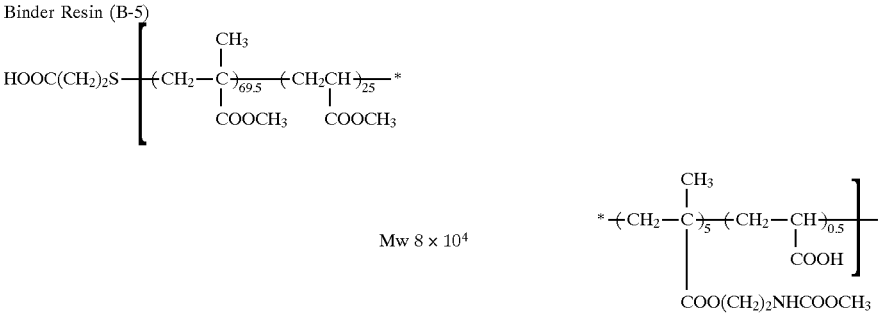

Mw 8 × $10^4$

Binder Resin (B-6)

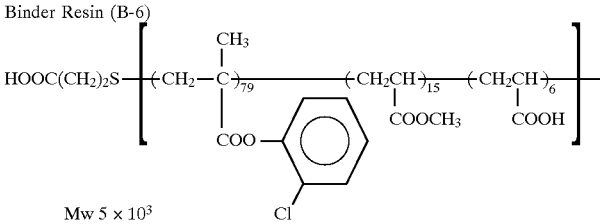

Mw 5 × $10^3$

Sensitizing Dye (S-3)

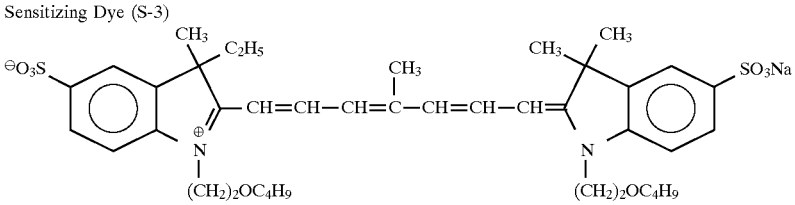

Sensitizing Dye (A)

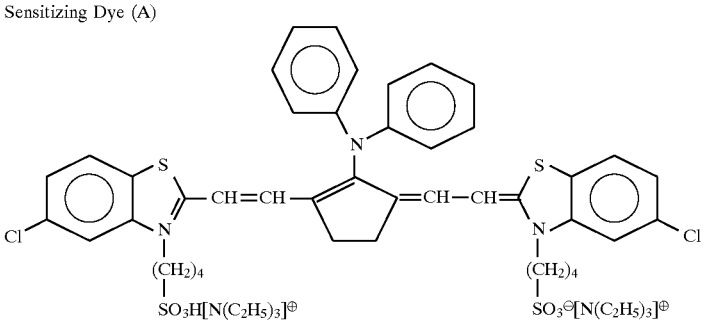

TABLE 5

(Image Quality of Processed Plate)

| Environmental Conditions | Example 3 | Comparative Example 1 |
|---|---|---|
| (I) (15° C., 20% RH) | A<br>Good in the uniformity of thin lines, thin letters and solid image | B<br>Slightly bad in the uniformity of solid image |
| (II) (20° C., 60% RH) | A<br>Good in the uniformity of thin lines, thin letters and solid image | B<br>Slightly bad in the uniformity of solid image |

TABLE 5-continued (Image Quality of Processed Plate)

| Environmental Conditions | Example 3 | Comparative Example 1 |
|---|---|---|
| (III) (30° C., 80% RH) | A<br>Good in the uniformity of thin lines, thin letters and solid image | C<br>Dropping of thin lines and thin letters, and unevenness in solid image were generated, and density was insufficient. |

As shown in Table 5, the sample of the present invention provided good electrophotographic properties and good uniformity of the image density even under severe conditions. Further, even when stored under severe conditions, the sample of the present invention achieved good electrophotographic properties and good uniformity of the image density and also showed good storage stability. On the contrary, the sample of comparative example was reduced remarkably in the electrophotographic properties under severe conditions and also, the uniformity of image density was seriously deteriorated. Further, when the sample was stored under severe conditions, the electrophotographic properties were further reduced and the uniformity of image density was also deteriorated remarkably.

EXAMPLES 4 TO 7

Electrophotographic lithographic printing plates were prepared in the same manner as in Example 3 except for using $1.0\times10^{-4}$ mol of a sensitizing dye and a chemical sensitizer shown in Table 6 in place of Sensitizing Dye (S-3) and chloromaleic anhydride used in Example 3, respectively.

Each printing plate was processed into a plate in the same manner as in Example 1 and, as a result, good image quality on the same level as comparable to that in Example 1 was achieved in each plate. Further, when the environmental conditions in plate making were changed to high temperature and high humidity conditions (30° C., 80% RH) or low temperature and low humidity conditions (15° C., 20% RH), the image quality obtained was almost the same as that obtained in the plate making at room temperature and normal humidity.

TABLE 6

| Example | Sensitizing Dye (S) | Chemical Sensitizer | |
|---|---|---|---|
| 4 | 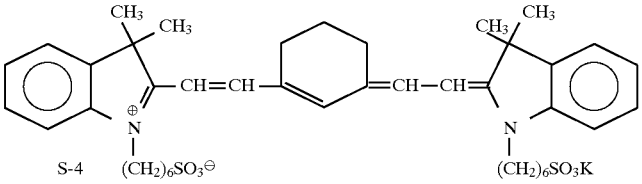 S-4 | Methyl-N-hydroxymaleinimido | 0.2 part |
| 5 | 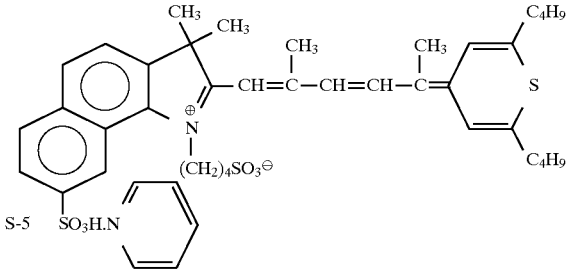 S-5 | Thiosalicylic acid<br>2,3-Dimethylmaleic anhydride | 0.12 part<br>0.10 part |
| 6 | 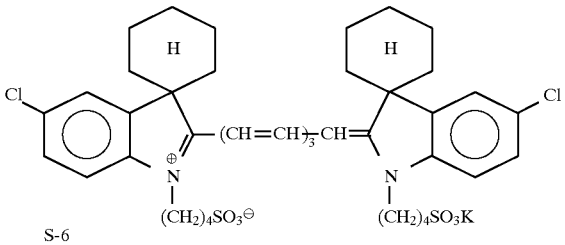 S-6 | Chlorophthalic anhydride | 0.18 part |
| 7 | 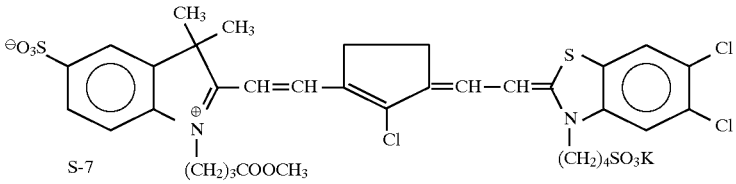 S-7 | Pyromellitic anhydride<br>2,6-Dimethoxybenzoic acid | 0.15 part<br>0.2 part |

EXAMPLES 8 TO 15

Electrophotographic lithographic printing plates of the present invention were prepared by coating a support prepared using the back layer (f) in Example 1 with a composition for the photoconductive layer having the following formulation so as to give a dry coating amount of 22 g/m$^2$.

| Formulation of Photoconductive Layer Composition: | |
|---|---|
| Photoconductive zinc oxide (produced by Seido Kagaku KK) | 100 parts |
| Binder Resin (B-4) | 2 parts |
| Binder Resin (B-7) shown below | 5 parts |
| Binder Resin (B-8) shown below | 13 parts |
| Sensitizing Dye (S-8) shown below | 0.010 part |
| Chemical sensitizer shown in Table 7 below | $1.5 \times 10^{-3}$ mol |

Binder Resin (B-7)

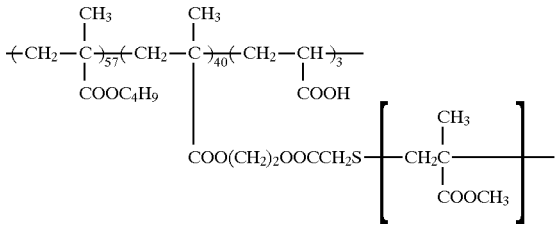

Mw 5 = $10^4$ (Mw in graft moiety: $1 \times 10^4$)

Binder Resin (B-8)

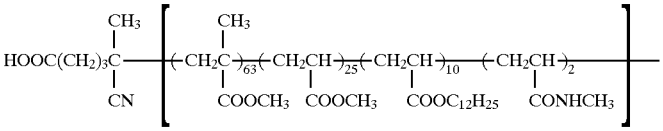

Mw $8 \times 10^4$

Sensitizing Dye (S-8)

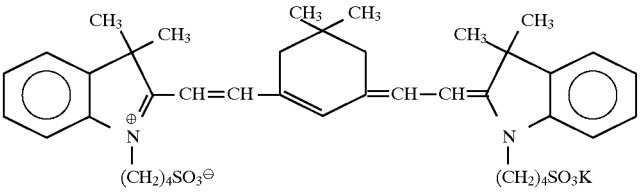

TABLE 7

| Example | Chemical Sensitizer |
|---|---|
| 8 | N-Hydroxy-5-norbornene-2,3-dicarboxyimido |
| 9 | N-Hydroxy-1-cyclohexene-1,2-dicarboxyimido |
| 10 | N-Hydroxy-1,8-naphthalimido |
| 11 | N-Phthaloyl-L-glutaric acid |
| 12 | 3-Phenoxypropionic acid/methylmaleic anhydride (1/1 by mol) |
| 13 | 4-Methoxycarbonylphthalic anhydride/lauric acid (2/1 by mol) |
| 14 | 3,3',4,4'-Benzophenonetetracarboxylic dianhydride |
| 15 | Cyclohexane 1,2-dicarboxylimido/4-methoxybutyric acid (1/1 by mol) |

When the printing plates were processed into a plate in the same manner as in Example 1, the image quality was good similar to Example 1 in each sample.

Further, when the environmental conditions in plate making were changed to high temperature and high humidity conditions (30° C., 80% RH) or low temperature and low humidity conditions (15° C., 20% RH), the image quality obtained was almost the same as that obtained in the plate making at room temperature and normal humidity.

According to the present invention, an image formation method using scanning exposure is provided, which ensures excellent electrophotographic properties (in particular, the sensitivity, dark-charge receptivity) independent on the environment, gives a good image and is suitable for development in a direct feeding system.

while the invention has been described in detail and with reference to specific embodiments thereof, it will be apparent to one skilled in the art that various changes and modifications can be made therein without departing from the spirit and scope thereof.

What is claimed is:

1. A method for forming an image using scanning exposure of an electrophotographic lithographic printing plate comprising an electrically conductive support having thereon a photoconductive layer containing an inorganic photoconductor, a chemical sensitizer, a sensitizing dye and a binder resin, and a back layer on the opposite side of said photoconductive layer, wherein said back layer has a surface resistivity of $1 \times 10^{10}$ Ω or less and the sensitizing dye in said photoconductive layer is at least one selected from the compounds represented by the following formulae (I) and (II):

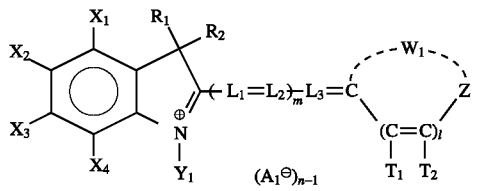

(I)

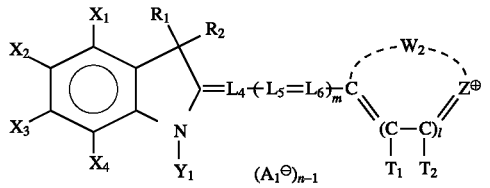

(II)

wherein $R_1$ and $R_2$ which may be the same or different, each represents an alkyl group, an alkenyl group or an aralkyl group or $R_1$ and $R_2$ each may be a hydrocarbon group forming an alicyclic ring;

$X_1$, $X_2$, $X_3$ and $X_4$, which may be the same or different, each represents a hydrogen atom or a group selected from respective substituent groups defined by the Hammett's substituent constant, or $X_1$ and $X_2$ or $X_3$ and $X_4$ each may be a hydrocarbon group forming a benzene ring;

$Y_1$ represents an alkyl, alkenyl or aralkyl group which may be substituted;

Z represents an oxygen atom, a sulfur atom, a selenium atom, a tellurium atom or a nitrogen atom substituted by a substituent $Y_2$ (wherein $Y_2$ has the same meaning as $Y_1$ above and $Y_1$, and $Y_2$ in each formula may be the same or different);

$W_1$ represents an atomic group necessary for forming an indolenine, naphthoindolenine, pyran, benzopyran, naphthopyran, thiopyran, benzothiopyran, naphthothiopyran, selenapyran, benzoselenapyran, naphthoselenapyran, tellurapyran, benzotellurapyran, naphthotellurapyran, benzothiazole or naphthothiazole ring which may be substituted or an atomic group necessary for forming a nitrogen-containing heterocyclic ring which may be substituted;

$W_2$ represents an onium salt of a heterocyclic group as formed in the manner defined for $W_1$;

$T_1$ and $T_2$, which may be the same or different, each represents a hydrogen atom, an aliphatic group or an aromatic group;

$L_1$, $L_2$, $L_3$, $L_4$, $L_5$ and $L_6$, which may be the same or different, each represents a methine group which may be substituted;

l represents 0 or 1;

m represents 2 or 3;

$A_1^-$ represents an anion; and n represents 1 or 2, provided that when the dye molecule contains a sulfo group or a phospho group, an inner salt is formed and n is 1.

2. The image formation method using scanning exposure as claimed in claim 1, wherein said electrophotographic lithographic printing plate is subjected to wet development by disposing an electrode to face the photoconductive layer, supplying a developer between said electrode and the photoconductive layer and bringing a conductor into contact with the surface of said back layer.

* * * * *